US006296999B1

(12) United States Patent
Uyttendaele et al.

(10) Patent No.: US 6,296,999 B1
(45) **Date of Patent: *Oct. 2, 2001**

(54) SUBBING LAYERS FOR USE WITH THERMOGRAPHIC MATERIALS

(75) Inventors: Carlo Uyttendaele, Mortsel; Ingrid Geuens, Emblem; Ivan Hoogmartens, Wilrijk, all of (BE)

(73) Assignee: Agfa-Gevaert (BE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/137,367

(22) Filed: Aug. 20, 1998

Related U.S. Application Data

(60) Provisional application No. 60/069,213, filed on Dec. 11, 1997.

(30) Foreign Application Priority Data

Sep. 17, 1997 (EP) ..... 97202877

(51) Int. Cl.[7] ..... G03C 1/498

(52) U.S. Cl. ..... 430/617; 430/530; 430/531; 430/533; 427/148; 503/210; 503/214

(58) Field of Search ..... 430/617, 530, 430/619, 531, 523, 533; 503/210, 214, 202; 427/150, 148

(56) References Cited

U.S. PATENT DOCUMENTS 5,264,334 * 11/1993 Przezdziecki et al. ..... 430/523

FOREIGN PATENT DOCUMENTS 0736799 10/1996 (EP) .
0779539 6/1997 (EP) .

OTHER PUBLICATIONS

The Condensed Chemical Dictionary, Tenth Edition, Revised by Gessner G. Hawley, pp. 601–601, 1981.*
Hackh's Chemical Dictionary, p. 380, 1969.*

* cited by examiner

*Primary Examiner*—Thorl Chea
(74) *Attorney, Agent, or Firm*—Leydig, Voit & Mayer, Ltd.

(57) ABSTRACT

A substantially light-insensitive black and white thermographic material comprising a polymeric or polymer-coated support, a subbing layer on the support and on the same side of the support as the subbing layer a thermosensitive element containing a substantially light-insensitive organic silver salt, a reducing agent therefor in thermal working relationship therewith and a binder, wherein the subbing layer contains a binder, less than 20% by weight of silica and covalently bonded acid groups in the binder, if present, are either substantially present as free acid or substantially present as acid salts and has a leachable non-fluoro-halide ion content into water at room temperature over a period of 120 minutes of less than 0.6 mg/m$^2$; and a process for producing the substantially light-insensitive thermographic material comprising the steps of: coating the support with a subbing layer-composition thereby forming the subbing layer; producing one or more aqueous coating compositions together containing the substantially light-insensitive organic silver salt, the reducing agent and the binder; and applying the one or more aqueous coating compositions to the same side of the support as the subbing layer thereby forming after drying the thermosensitive element.

11 Claims, No Drawings

SUBBING LAYERS FOR USE WITH THERMOGRAPHIC MATERIALS

The application claims the benefit of U.S. Provisional Application No. 60/069,213 filed Dec. 11, 1997.

FIELD OF THE INVENTION

The present invention relates to a substantially light-insensitive thermographic material comprising a subbing layer with a low concentration of leachable non-fluoro-halide ions.

BACKGROUND OF THE INVENTION

Thermal imaging or thermography is a recording process wherein images are generated by the use of thermal energy.

In thermography three approaches are known:

1. Direct thermal formation of a visible image pattern by image-wise heating of a recording material containing matter that by chemical or physical process changes colour or optical density.

2. Image-wise transfer of an ingredient necessary for the chemical or physical process bringing about changes in colour or optical density to a receptor element.

3. Thermal dye transfer printing wherein a visible image pattern is formed by transfer of a coloured species from an image-wise heated donor element onto a receptor element.

Most of the "direct" thermographic materials are of the chemical type. On heating to a certain conversion temperature, an irreversible chemical reaction takes place and a coloured image is produced. A wide variety of chemical systems has been suggested some examples of which have been given on page 138 of "Imaging Systems" by Kurt I. Jacobson-Ralph E. Jacobson, The Focal Press—London and New York (1976), describing the production of a silver metal image by means of a thermally induced oxidation-reduction reaction of a silver soap with a reducing agent.

JP 57-69,095 discloses a support coated with a subbing layer containing an ionomer, and then coated with a heat-sensitive recording layer whose solubility in water decreases upon heating to give a thermographic sheet. EP-A 496 017 discloses a heat-sensitive recording medium, comprising: (a) a synthetic-resin support; (b) an ionomer-resin layer on said support; and (c) a heat-sensitive recording layer on said ionomer resin layer.

GB 2 114 767 discloses a thermosensitive recording sheet comprising: a support material; a primer layer formed on the support material and comprising a filler and a binder agent; a thermosensitive colouring layer formed on the primer layer and comprising a colourless light-coloured leuco dye, and an acidic material which colours the leuco dye upon application of heat hereto; and a protective layer formed on the thermosensitive colouring layer and comprising a water-soluble agent and a filler.

U.S. Pat. No. 5,006,451 discloses in the specification that "polymeric subbing layers used to promote the adhesion of coating compositions to polyester film supports are very well known in the photographic art. Useful compositions for this purpose include interpolymers of vinylidene chloride such as vinylidene chloride/acrylonitrile/acrylic acid-terpolymers or vinylidene chloride/methyl acrylate/itaconic acid-terpolymers".

However, the inventors of the present invention found that the light-stability and archivability of substantially light-insensitive thermographic materials coated from aqueous media were surprisingly, considering their thinness relative to the thickness of the thermosensitive element thereof, dependent upon the choice of subbing layer and that, moreover, polymer subbing layers used to promote adhesion between polyester support and conventional photographic emulsion layers were in the main unusable (see COMPARATIVE EXAMPLE 2) due to prohibitive light-sensitivity and poor archivability. There is therefore a need for subbing layers for use on the supports of thermographic materials, which have no adverse effect upon the light-stability and archivability of thermographic materials.

OBJECT OF THE INVENTION

It is therefore an object of the present invention to provide thermographic materials coatable from aqueous media which exhibit improved archivability and/or improved light stability, while maintaining high maximum density and low minimum density levels upon printing.

Further objects and advantages of the invention will become apparent from the description hereinafter.

SUMMARY OF THE INVENTION

Thermographic materials adhere poorly to unsubbed polyethylene terephthalate, as is shown in COMPARATIVE EXAMPLE 1. In the photographic art adhesion of the gelatinous silver halide emulsion layers to a polyethylene terephthalate support is attained by the use of a subbing layer consisting of two sub-layers, one to render the polyethylene terephthalate support sufficiently hydrophilic to adhere to a gelatinous layer to which gelatinous silver halide emulsion layers would adhere. COMPARATIVE EXAMPLE 2 shows that such a subbing layer indeed provides good adhesion between the polyethylene terephthalate support and gelatinous thermographic materials, but at the expense of poorer archivability and lower light stability. It is surprising that the composition of a subbing layer for the polymeric or polymer-coated support on the same side of the support as the thermosensitive element has a considerable influence on the light-stability and archivability of a substantially light-insensitive black and white thermographic material despite the thinness of a subbing layer compared to that of the thermosensitive element. In particular certain ingredients such as silica, whether colloidal or non-colloidal, have, above a concentration of 20% by weight, and the presence of non-fluoro-halide ions leachable into water at a concentration of 0.6 $mg/m^2$ or more have been found to have a prohibitive effect on the light-stability and archivability of thermographic materials coated from aqueous media.

The above-mentioned objects are realized with a substantially light-insensitive black and white thermographic material comprising a polymeric or polymer-coated support, a subbing layer on the support and on the same side of the support as the subbing layer a thermosensitive element containing a substantially light-insensitive organic silver salt, a reducing agent therefor in thermal working relationship therewith and a binder, wherein the subbing layer contains a binder, less than 20% by weight of silica and covalently bonded acid groups in said binder, if present, are either substantially present as free acid or substantially present as acid salts and has a leachable non-fluoro-halide ion content into water at room temperature over a period of 120 minutes of less than 0.6 $mg/m^2$.

A process is also provided for producing the above-referred to substantially light-insensitive thermographic material comprising the steps of: coating the support with a subbing-layer composition thereby forming the subbing layer; producing one or more aqueous coating compositions together containing the substantially light-insensitive organic silver salt, the reducing agent and the binder;

and applying the one or more aqueous coating compositions to the same side of the support as the subbing layer thereby forming after drying the thermosensitive element.

Preferred embodiments of the present invention are disclosed in the detailed description of the invention.

DETAILED DESCRIPTION OF THE INVENTION

Subbing Layer

The subbing layer used in accordance with the present invention contains a binder, has less than 20% by weight of silica, a leachable non-fluoro-halide ion content into water at room temperature of less than 0.6 mg/m$^2$ over a period of 120 minutes, and when the binder has covalently bonded acid groups the acid groups are either substantially present as free acid or substantially present as acid salts. The subbing layer used in accordance with the present invention may consist of one or more sub-layers. The leachable non-fluoro-halide ion is preferably a chloride ion.

By the term ionic group is meant an ionized group, for example carboxylate, sulfinate, sulfonate, quaternary ammonium, quaternary phosphonium, ternary sulfonium and phosphate groups. Suitable binders include any natural, modified natural or synthetic resins, polysilicic acid, hydrolyzed polyalkoxysilanes etc. or mixtures thereof.

The preferred leachable non-fluoro-halide ion content of the subbing layer used in accordance with the present invention is less than 0.5 mg/m$^2$, with less than 0.4 mg/m$^2$ being particularly preferred.

Preferred ingredients for the subbing layer used in accordance with the present invention are a polymer latex, polyethylene wax and hydrolyzed polyalkoxysilanes. By the term polyalkoxysilane is meant a silane with a least two hydrolyzable alkoxy-groups. Particularly preferred polymer latexes for use in the subbing layer of the present invention are producible with monomers selected from the group consisting of acrylates, methacrylates, vinyl esters, acrylic acid, methacrylic acid, itaconic acid, vinylidene chloride, polyisocyanates, aromatic polycarboxylic acids and polyols.

Suitable ingredients for use in the subbing layer in accordance with the present invention are:

- 3-glycidoxypropyltrimethoxysilane hydrolyzed in the presence of polystyrene sulfonic acid;
- a copolymer consisting of 80% by weight of ethyl acrylate and 20% by weight of methacrylic acid;
- a copolyester consisting of 26.5 mol % of terephthalic acid, 20 mol % of isophthalic acid, 3.5 mol % of sulfo-isophthalic acid and 50 mol % of ethylene glycol;
- polyethylene wax;
- melamine-formaldehyde resin;
- polymethylmethacrylate particles; and
- silica up to 20% by weight of the subbing layer.

Aqueous

The term aqueous for the purposes of the present invention includes mixtures of water with water-miscible organic solvents such as alcohols e.g. methanol, ethanol, 2-propanol, butanol, iso-amyl as alcohol, octanol, cetyl alcohol etc.; glycols e.g. ethylene glycol; glycerine; N-methyl pyrrolidone; methoxypropanol; and ketones e.g. 2-propanone and 2-butanone etc.

Substantially

By substantially light-insensitive is meant not intentionally light sensitive. By substantially solvent-free aqueous medium is meant that solvent, if present, is present in amounts below 10% by volume of the aqueous medium.

Thermosensitive Element

According to the present invention, a thermographic material is provided comprising a thermosensitive element including a substantially light-insensitive organic silver salt, an organic reducing agent therefor in thermal working relationship therewith and a binder. The element may comprise a layer system in which the ingredients may be dispersed in different layers, with the proviso that the substantially light-insensitive organic silver salt and the organic reducing agent are in thermal working relationship with one another i.e. during the thermal development process the reducing agent must be present in such a way that it is able to diffuse to the substantially light-insensitive organic silver salt particles so that reduction of the organic silver salt can take place.

Organic Silver Salts

Preferred substantially light-insensitive organic silver salts used in the thermographic materials, according to the present invention, are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Silver salts of modified aliphatic carboxylic acids with thioether group as described e.g. in GB-P 1,111,492 and other organic silver salts as described in GB-P 1,439,478, e.g. silver benzoate, may likewise be used to produce a thermally developable silver image. Combinations of different organic silver salts may also be used in the thermographic materials of the present invention.

Production of Particles of Organic Silver Salts

A process for producing a suspension of particles containing a substantially light-insensitive organic silver salt is disclosed in EP-A 754 969.

Organic Reducing Agents

Suitable organic reducing agents for use in the thermographic materials of the present invention for the reduction of the substantially light-insensitive organic silver salt, are organic compounds containing at least one active hydrogen atom linked to O, N or C, such as is the case with: catechol; hydroquinone; aminophenols; METOL™; p-phenylenediamines; alkoxynaphthols, e.g. 4-methoxy-l-naphthol described in U.S. Pat. No. 3,094,417; pyrazolidin-3-one type reducing agents, e.g. PHENIDONE™; pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

Auxiliary Reducing Agents

The reducing agents used in accordance with the present invention being considered as primary or main reducing agents may be used in conjunction with so-called auxiliary reducing agents. Such auxiliary reducing agents are e.g. sterically hindered phenols, such as described in U.S. Pat. No. 4,001,026; bisphenols, e.g. of the type described in U.S. Pat. No. 3,547,648; sulfonamidophenols, such as described in Research Disclosure, Feb. 1979, item 17842, in U.S. Pat. Nos. 4,360,581 and 4,782,004, and in EP-A 423 891; hydrazides such as disclosed in EP-A 762 196, sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. Nos. 5,545,505, 5.545.507 and 5,558,983; acrylonitrile compounds as disclosed in U.S. Pat. Nos. 5,545,515 and 5,635,339; and organic reducing metal salts, e.g. stannous stearate described in U.S. Pat. Nos. 3,460,946 and 3,547,648 or organic reducing metal salts, e.g. stannous stearate described in U.S. Pat. Nos. 3,460,946 and 3,547,648. The auxiliary reducing agents may be present in the imaging layer or in a polymeric binder layer in thermal working relationship thereto.

Suitable water-dispersible binders are any water-insoluble polymer. It should be noted that there is no clear cut transition between a polymer dispersion and a polymer solution in the case of very small polymer particles resulting in the smallest particles of the polymer being dissolved and those slightly larger being in dispersion. Preferred water-dispersible binders for use according to the present invention are water-dispersible film-forming polymer with covalently bonded ionic groups selected from the group consisting of sulfonate, sulfinate, carboxylate, phosphate, quaternary ammonium, tertiary sulfonium and quaternary phosphonium groups. Water-dispersible binders with crosslinkable groups, e.g. epoxy groups, aceto-acetoxy groups and crosslinkable double bonds are also preferred.

Further preferred water-dispersible binders for use in the present invention are polymer latexes. Compositions of polymer latexes suitable for use in the present invention are given in the table below:

| polymer latex nr. | B [% by wt.] | IP [% by wt.] | BA [% by wt.] | S [% by wt.] | MMA [% by wt.] | IA [% by wt.] | AA [% by wt.] |
|---|---|---|---|---|---|---|---|
| 1 | 47.5 | — | — | — | 47.5 | 5 | — |
| 2 | 45 | — | — | — | 45 | 10 | — |
| 3 | 49 | — | — | — | 49 | 2 | — |
| 4 | — | 47.5 | — | — | 47.5 | 5 | — |
| 5 | — | — | 50 | 50 | — | — | — |
| 6 | — | — | 47 | — | 53 | — | — |
| 7 | — | — | 51 | — | 49 | — | — |
| 8 | — | 55 | 44 | — | — | — | 1 |
| 9 | 50 | — | — | — | 50 | — | — |

where :B = butadiene; IP = isoprene; BA = butyl acrylate; S = styrene; MMA = methyl methacylate; IA = itaconic acid; and AA = acrylic acid.

Binder

The thermosensitive element of the thermographic materials of the present invention may be coated onto a support in sheet- or web-form from an organic solvent containing the binder dissolved therein or may be applied from an aqueous medium using water-soluble or water-dispersible binders.

Suitable binders for coating from an organic solvent are all kinds of natural, modified natural or synthetic resins or mixtures of such resins, wherein the organic heavy metal salt can be dispersed homogeneously: e.g. cellulose derivatives, cellulose esters, carboxymethylcellulose, starch ethers, galactomannan, polyurethanes, polyesters, polymers derived from α,β-ethylenically unsaturated compounds such as after-chlorinated polyvinyl chloride, partially hydrolyzed polyvinyl acetate, polyvinyl alcohol, polyvinyl acetals preferably polyvinyl butyral and homopolymers and copolymers produced using monomers selected from the group consisting of: vinyl chloride, vinylidene chloride, vinyl esters, acrylonitrile, acrylamides, methacrylamides. methacrylates, acrylates, methacrylic acids, acrylic acids, vinyl esters, styrenes and alkenes; or mixtures thereof.

Suitable water-soluble film-forming binders are: polyvinyl alcohol, polyacrylamide, polyacrylic acid, polymethacrylic acid, polyethyleneglycol, polyvinylpyrrolidone, proteinaceous binders such as gelatine, modified gelatines such as phthaloyl gelatine, polysaccharides, such as starch, gum arabic and dextran and water-soluble cellulose derivatives.

The binder to organic silver salt weight ratio is preferably in the range of 0.2 to 6, and the thickness of the recording layer is preferably in the range of 1 to 50 μm.

Thermal Solvents

The above mentioned binders or mixtures thereof may be used in conjunction with waxes or "heat solvents" also called "thermal solvents" or "thermosolvents" improving the reaction speed of the redox-reaction at elevated temperature.

Toning Agents

In order to obtain a neutral black image tone in the higher densities and neutral grey in the lower densities, thermographic materials according to the present invention may contain one or more toning agents. The toning agents should be in thermal working relationship with the substantially light-insensitive organic silver salt and reducing agents during thermal processing. Any known toning agent from thermography or photothermography may be used. Suitable toning agents are the phthalimides and phthalazinones within the scope of the general formulae described in U.S. Pat. No. 4,082,901 and the toning agents described in U.S. Pat. Nos. 3,074,809, 3,446,648 and 3,844,797. Particularly useful toning agents are the heterocyclic toner compounds of the benzoxazine dione or naphthoxazine dione type described in GB-P 1,439,478, U.S. Pat. Nos. 3,951,660 and 5,599,647.

Surfactants and Dispersants

The thermographic materials of the present invention may further contain one or more surfactants. These surfactants may be anionic, non-ionic or cationic surfactants. Examples of suitable surfactants are:

| | |
|---|---|
| Surfactant Nr. 1 = | HOSTAPAL ™ BV, a sodium trisalkyl-phenyl-polyethyleneglycol (EO 7-8) sulphate from Hoechst; |
| Surfactant Nr. 2 = | MERSOLAT ™ H80, a sodium hexadecyl-sulfonate from Bayer; |
| Surfactant Nr. 3 = | ULTRAVON ™ W, a sodium arylsulfonate from Ciba-Geigy; |
| Surfactant Nr. 4 = | TERGITOL ™ 4, a sodium 1-(2'-ethylbutyl)-4-ethylhexylsulfate; |
| Surfactant Nr. 5 = | MARLON ™ A-396, a sodium dodecylphenyl-sulfonate from Hüls; |
| Surfactant Nr. 6 = | HOSTAPAL ™ W, a nonylphenylpolyethylene-glycol from Hoechst; |
| Surfactant Nr. 7 = | AKYPO ™ OP 80, supplied by CHEMY as an 80% con-centrate of an octyl-phenyl-oxy-polyethylene-glycol (EO 8)acetic acid; |
| Surfactant Nr. 8 = | ammonium dodecylphenyl sulfonate; |
| Surfactant Nr. 9 = | hexadecyl-dimethylammonium acetic acid. |

In the thermographic materials of the present invention the surfactant requirement is mainly that required to disperse the substantially light-insensitive organic silver salt.

The thermographic materials according to the present invention may also contain dispersants. Suitable dispersants are: natural polymeric substances, a synthetic polymeric substances and finely divided powders, e.g. silica.

Stabilizers and Antifoggants

In order to obtain improved shelf-life and reduced fogging, stabilizers and antifoggants may be incorporated into the thermographic materials of the present invention.

Other Ingredients

In addition to said ingredients the thermographic material may contain other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, ultraviolet light absorbing compounds, white light reflecting and/or ultraviolet radiation reflecting pigments, silica, and/or optical brightening agents.

Support

The support for the thermographic material according to the present invention is polymer or polymer-coated and may be transparent, translucent or opaque and is preferably a thin flexible carrier made e.g. from transparent resin film, e.g. made of a cellulose ester, e.g. cellulose triacetate, polypropylene, polycarbonate or polyester, e.g. polyethylene terephthalate. The support may be in sheet, ribbon or web form. The support may be made of an opacified resin composition.

Protective Layer

A protective layer may also be provided for the thermosensitive element. In general this protects the thermosensitive element from atmospheric humidity and from surface damage by scratching etc. and prevents direct contact of printheads or heat sources with said recording layers. Protective layers for thermosensitive elements which come into contact with and have to be transported past a heat source under pressure, have to exhibit resistance to local deformation and good slipping characteristics during transport past the heat source during heating.

A slipping layer, being said outermost layer, may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder. Suitable slipping layer compositions are described, for example, in EP 138 483, EP 227 090, U.S. Pat. Nos. 4,567,113, 4,572,860, 4,717,711, EP-A 311 841, U.S. Pat. Nos. 5,587,350, 5,536,696, 5,547,914, WO 95/12495, EP-A 775 592 and EP-A 775 595.

Coating

The coating of any layer of the thermographic materials of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, USA

Thermographic Printing

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. Such thermal printing heads may be used in contact or close proximity with the recording layer. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with a recording layer not provided with an outermost protective layer, the image-wise heating of the recording layer with said thermal printing heads may proceed through a contacting but removable resin sheet or web wherefrom during said heating no transfer of recording material can take place.

The image signals for modulating the laser beam or current in the micro-resistors of a thermal printhead are obtained directly e.g. from opto-electronic scanning devices or from an intermediary storage means, e.g. magnetic disc or tape or optical disc storage medium, optionally linked to a digital image work station wherein the image information can be processed to satisfy particular needs.

Activation of the heating elements can be power-modulated or pulse-length modulated at constant power. EP-A 654 355 describes a method for making an image by image-wise heating by means of a thermal head having energizable heating elements, wherein the activation of the heating elements is executed duty cycled pulse-wise. When used in thermographic recording operating with thermal printheads said thermographic materials are not suitable for reproducing images with fairly large number of grey levels as is required for continuous tone reproduction. EP-A 622 217 discloses a method for making an image using a direct thermal imaging element producing improvements in continuous tone reproduction. Image-wise heating of the thermographic material can also be carried out using an electrically resistive ribbon incorporated into said material. Image- or pattern-wise heating of the thermographic material may also proceed by means of pixel-wise modulated ultra-sound, using e.g. an ultrasonic pixel printer as described e.g. in U.S. Pat. No. 4,908,631.

Industrial Applications

Thermographic materials according to the present invention may be used for both the production of transparencies, for example in the medical diagnostic field in which black-imaged transparencies are widely used in inspection techniques operating with a light box, and reflection type prints, for example in the hard copy field. For such applications the support will be transparent or opaque, i.e. having a white light reflecting aspect. Should a transparent base be used, the base may be colourless or coloured, e.g. with a blue colour for medical diagnostic applications.

The following examples and comparative examples illustrate the present invention. The percentages and ratios used in the examples are by weight unless otherwise indicated. In the COMPARATIVE and INVENTION EXAMPLES the following ingredients were used in addition to those already mentioned above:

i) Subbing Layer Ingredients

| | |
|---|---|
| PAREZ RESIN ™ 707: | a 80% solids melamine-formaldehyde resin from AMERICAN CYANAMID; |
| HORDAMER ™ PE02: | a 40% aqueous dispersion of polyethylene from HOECHST; |
| PSS: | polystyrene sulfonic acid |
| R 10985: | a calcium-containing medium viscosity gelatin from ROUSSELOT; |
| MOBILCER ™ Q: | a microcrystalline polyethylene wax from Mobil Oil |
| KIESELSOL 100F: | a 36% aqueous dispersion of colloidal silica from BAYER; |
| KIESELSOL 300F: | a 30% aqueous dispersion of colloidal silica from BAYER; |
| PMMA: | a 20% aqueous dispersion of polymethylmethacrylate particles 2 μm in diameter |

ii) Thermosensitive Element Ingredients

| | |
|---|---|
| K7598 = | KOEPF ™ Type 7598, a calcium-free gelatine; |
| GEL01 = | a calcium-free gelatin; |
| AgBeh = | silver behenate |
| R01 = | ethyl 3,4-dihydroxybenzoate |
| T01 = | 7-(ethylcarbonato) benzo[e] [1,3]oxazine-2,4-dione |
| T02 = | benzo[e] [1,3]oxazine-2,4-dione |

Preparation of Subbing Layers

Subbing Layer Number C1

A 0.34 mm thick polyethylene terephthalate sheet was first coated to a wet thickness of 7 μm with a composition which after drying and longitudinal and transverse stretching produced a 175 μm thick support coated with a sub-layer with the following composition, expressed as the coating weights of the ingredients present:

| | |
|---|---|
| # terpolymer latex of vinylidene chloride/methyl acrylate/itaconic acid (88/10/2): | 162 mg/m$^2$ |
| # colloidal silica (KIESELSOL ™ 100F from BAYER): | 38 mg/m$^2$ |
| # alkyl sulfonate surfactant (Surfactant Nr. 2): | 0.6 mg/m$^2$ |
| # aryl sulfonate surfactant (Surfactant Nr. 3): | 4 mg/m$^2$ |

The 175 μm thick longitudinally stretched polyethylene terephthalate support was then coated on one side with a composition which after drying at 130° C. produced a second sub-layer with the following layer composition, expressed as the coating weights of the ingredients present:

| | |
|---|---|
| # gelatin (R 10985): | 380 mg/m$^2$ |
| # colloidal silica (KIESELSOL ™ 300F): | 341 mg/m$^2$ |
| # PNMA: | 1 mg/m$^2$ |
| # an alkylpolyethylene glycol (Surfactant Nr. 6): | 7 mg/m$^2$ |
| # aryl sulfonate surfactant (Surfactant Nr. 3): | 13 mg/m$^2$ |
| # 4-chloro-3-methylphenol: | 10 mg/m$^2$ |
| # 1,2,6-trihydroxyhexane: | 25 mg/m$^2$ |

These two sub-layers together form subbing layer number C1, which is used in the photographic art as a subbing layer for providing adhesion between a polyethylene terephthalate support and gelatinous silver halide emulsion layers.

Subbing Layer Number C2

A 0.34 mm thick polyethylene terephthalate sheet was first coated to a wet thickness of 7 μm with a composition which after drying and longitudinal and transverse stretching produced a 175 μm thick support coated with a sub-layer with the following composition, expressed as the coating weights of the ingredients present:

| | |
|---|---|
| # terpolymer latex of vinylidene chloride/methyl acrylate/itaconic acid (88/10/2): | 162 mg/m$^2$ |
| # colloidal silica (KIESELSOL ™ 100F from BAYER): | 38 mg/m$^2$ |
| # alkyl sulfonate surfactant (Surfactant Nr. 2): | 0.6 mg/m$^2$ |
| # aryl sulfonate surfactant (Surfactant Nr. 3): | 4 mg/m$^2$ |

The 175 μm thick longitudinally stretched polyethylene terephthalate support was then coated on one side with a composition which after drying at 130° C. produced a second sub-layer with the following layer composition, expressed as the coating weights of the ingredients present:

| | |
|---|---|
| # gelatin (R 10985): | 380 mg/m$^2$ |
| # colloidal silica (KIESELSOL ™ 300F): | 341 mg/m$^2$ |
| # PMMA: | 1 mg/m$^2$ |
| # an alkylpolyethylene glycol (Surfactant Nr. 6): | 7 mg/m$^2$ |
| # aryl sulfonate surfactant (Surfactant Nr. 3): | 13 mg/m$^2$ |
| # hexylene glycol: | 22 mg/m$^2$ |
| # trimethylolpropane: | 11 mg/m$^2$ |

These two sub-layers together form subbing layer number C2, which is used in the photographic art as a subbing layer for providing adhesion between a polyethylene terephthalate support and gelatinous silver halide emulsion layers.

Subbing Layer Number C3

A 0.34 mm thick polyethylene terephthalate sheet was coated to a thickness of 0.1 mm with a composition which after drying and longitudinal and transverse stretching produced a 175 μm thick support coated with the following subbing-layer composition of SUBBING LAYER NUMBER C2 expressed as the coating weights of the ingredients present:

| | |
|---|---|
| # terpolymer latex of vinylidene chloride/methyl acrylate/itaconic acid (88/10/2): | 162 mg/m$^2$ |
| # colloidal silica (KIESELSOL ™ 100F from BAYER): | 38 mg/m$^2$ |
| # alkyl sulfonate surfactant (Surfactant Nr. 2): | 0.6 mg/m$^2$ |
| # aryl sulfonate surfactant (Surfactant Nr. 3): | 4 mg/m$^2$ |

Subbing Layer Number 01

A 0.34 mm thick polyethylene terephthalate sheet was coated to a thickness of 0.1 mm with a composition which after drying and longitudinal and transverse stretching produced a 175 μm thick support coated on with the following subbing-layer composition of subbing layer number 01 expressed as the coating weights of the ingredients present:

| | |
|---|---|
| # copolymer of terephthalic acid/isophthalic acid/sulfo-isophthalic acid/ethylene glycol 26.5/20/3.5/50): | 37.0 mg/m$^2$ |
| # copolymer latex of ethyl acrylate/methacrylic acid (80/20): | 3.0 mg/m$^2$ |
| # HORDAMER ™ PE02: | 1.0 mg/m$^2$ |
| # PAREZ RESIN ™ M 707: | 7.0 mg/m$^2$ |

Subbing Layer Number 02

A 0.34 mm thick polyethylene terephthalate sheet was coated to a thickness of 7 μm with a composition which after drying and longitudinal and transverse stretching produced a 175 μm thick support coated with the following subbing-layer composition of subbing layer number 02 expressed as the coating weights of the ingredients present:

| | |
|---|---|
| # hexadecyldimethylammonio-acetic acid: | 1 mg/m$^2$ |
| # 3-glycidoxypropyltrimethoxy silane hydrolyzed in presence of PSS: | 30 mg/m$^2$ |
| # polystyrene sulfonic acid (PSS): | 16 mg/m$^2$ |
| # colloidal silica (KIESELSOL ™ 300F from BAYER): | 4 mg/m$^2$ |
| # Mobilcer ™ Q: | 1 mg/m$^2$ |

Quantity of leachable non-fluoro-halide ions per unit surface of Subbing Layers

The chloride-ion content leachable during overcoating with an aqueous dispersion or solution was simulated by placing a 10×5 cm$^2$. piece of subbing layer-coated polyethylene terephthalate in 25 mL of deionized water for a period of 2 hours and determining the quantity of chloride ions leached out by injecting samples of the leaching water directly into a DIONEX QIK ANALYSER ion chromatograph. The detection limit with these measurements was limited to 0.1 ppm by the deionized water used in the leaching experiments, which had a chloride ion concentration of 0.02 to 0.06 ppm. The results obtained are given below in table 1:

Wavelength dispersive X-ray fluorescence (WDXRF) measurements were carried out on some of the supports to obtain a qualitative estimate of the total chlorine constant of the supports i.e. both covalently bound chlorine and chloride ions. These showed no detectable chlorine in an uncoated support, a very small quantity in subbing layer number 01 and a small quantity in subbing layer C3.

TABLE 1

| subbed support | | | | | | |
|---|---|---|---|---|---|---|
| side 1 | | side 2 | | concentration | quantity of leachable | chlorine |
| subbing layer number | coverage [mg/m$^2$] | subbing layer number | coverage [mg/m$^2$] | of leachable chloride ions [ppm] | chloride ions [mg/m$^2$ surface] | content with WDXRF [kcps] |
| — | 0 | — | 0 | 0 | 0 | <2 |
| C1 | 981.6 | C1 | 981.6 | 1987 | 1.95 | 51,452 |
| C2 | 979.6 | C2 | 979.6 | 1633 | 1.6 | — |
| C3 | 204.6 | C3 | 204.6 | 3177 | 0.65 | 27.5 |
| O1 | 48 | C2 | 989.9 | 915 | 0.95 | — |
| O2 | 52 | — | 0 | <9615 | <0.25 | |

The quantity of leachable chloride ions in the different subbing layers obtained from these measurements are summarized in table 2:

TABLE 2

| Subbing layer number | Quantity of leachable chloride ions [mg/m$^2$ surface] |
|---|---|
| C1 | 1.95 |
| C2 | 1.60 |
| C3 | 0.65 |
| O1 | 0.3# |
| O2 | <0.5* |
| — | 0* |

#calculated using results for the support with two C2 layers and for the support with one C2 layer and one 01 layer = (0.95 × 2) − 1.6 = 0.3 mg/m$^2$

*assuming that uncoated support has no leachable chloride ions on the basis of WDXRF measurements

COMPARATIVE EXAMPLES 1 to 3 AND INVENTION EXAMPLES 1 & 2

Preparation of a Silver Behenate Dispersion 1125 g of a 10% aqueous solution of Surfactant Nr 5 and 1500 g of silver behenate were added to 4875 g of deionized water and the mixture stirred for 30 minutes with a HOMOREX™ stirrer. The resulting dispersion was then stirred for 15 minutes with an ULTRA-TURRAX™ stirrer after which it was stored for 24 hours in a refrigerator to allow the foam to dissipate. The dispersion was then stirred for 10 minutes with an ULTRA-TURRAX™ stirrer and passed twice through a GUERIN homogenizer coupled with a MICROFLUIDICS™ microfluidizer at a pressure of 350 bar to obtain a finely divided aqueous silver behenate dispersion.

A gelatin solution was produced by adding 660 g of K7598 to 2319 g of deionized water, allowing the gelatin to swell for 30 minutes and heating the mixture to 50° C. The gelatin solution was then added to the aqueous silver behenate dispersion with vigorous stirring with a DISSOLVER™, after which the stirring was continued for a further 15 minutes producing a gelatinous aqueous dispersion of silver behenate containing: 14.3% of silver behenate, 1.07% of Surfactant Nr. 5 and 6.28% of gelatin.

Preparation of a Tone Modifier Dispersion

The tone modifier dispersion was prepared by first dissolving 8.8 g of K7598 in 71.4 g of deionized water by first adding the gelatin, then allowing the gelatin to swell for 30 minutes and finally heating to 50° C. 20 g of T01 was added with ULTRA-TURRAX™ stirring to this gelatin solution at 50° C., and the stirring continued for a further 5 minutes. Finally the resulting dispersion was pumped through a DYNOMILL™ for 2 hours to produce the final tone modifier dispersion containing: 20% of T01 and 8.8% of gelatin.

Preparation of the Thermosensitive Element

The coating dispersion was prepared by adding 324 g of the gelatinous aqueous dispersion of silver behenate to 165.7 g of deionized water, heating the dispersion to 36° C., then adding 81 g of the tone modifier dispersion as flakes, followed by stirring for 15 minutes before adding with stirring 70.8 g of a 30% latex dispersion of polymer latex number 1 at pH 5, a further 5 minutes stirring was followed by the addition with stirring of 103.24 g of a 7.25% aqueous solution of boric acid at 50° C., 11.01 g of R01 in 20.52 g of ethanol and 15.7 g of a 3.7% aqueous solution of formaldehyde to produce a dispersion containing: 5.85% of silver behenate, 0.44% of Surfactant nr 5, 3.47% of gelatin, 2.68% of polymer latex number 1, 1.39% of R01, 0.94% of boric acid, 2.05% of T01 and 0.07% of formaldehyde.

The resulting emulsion was then doctor blade-coated to a wet thickness of 60 $\mu$m with the blade at a setting of 100 $\mu$m onto an unsubbed 100 $\mu$m thick polyethylene terephthalate support in the case of COMPARATIVE EXAMPLE 1 and a 175 $\mu$m thick polyethylene terephthalate supports coated with different subbing layers in the cases of COMPARATIVE EXAMPLE 2 & 3 and INVENTION EXAMPLES 1 & 2 and dried for 10 minutes at 50° C., producing a silver behenate coverage of 3.8 g/m$^2$.

Adhesion Test

The adhesion of the thermosensitive element to the polyethylene terephthalate support was evaluated for the thermographic materials of COMPARATIVE EXAMPLES 1 to 3 and INVENTION EXAMPLES 1 & 2 using a tape test. In carrying out the test a 10×10 cm$^2$ sample was prepared and laid flat on a table and a section of TESAPACK™ 4122 tape, available from BEIERSDORF AG, Hamburg, Germany, was placed across the width of the sample and smoothed out by hand to ensure uniform adhesion. Upon manually removing the tape, the area of thermosensitive element removed from the polyethylene terephthalate support was estimated and related to adhesion as follows:

| | |
|---|---|
| poor adhesion = | more than 50% of the thermosensitive element removed |
| moderate adhesion = | 20 to 49% of the thermosensitive element removed |
| good adhesion = | 1 to 19% of the thermosensitive element removed |
| excellent adhesion = | none of the thermosensitive element removed |

Thermographic Printing

During printing of the recording materials of COMPARATIVE EXAMPLES 1 to 3 and INVENTION EXAMPLES 1 & 2 the print head was separated from the imaging layer by a thin intermediate material contacted with a slipping layer of a separable 5 $\mu$m thick polyethylene terephthalate ribbon coated successively with a subbing layer, heat-resistant layer and the slipping layer (anti-friction layer) giving a ribbon with a total thickness of 6 $\mu$m.

The printer was equipped with a thin film thermal head with a resolution of 300 dpi and was operated with a line time of 19 ms (the line time being the time needed for printing one line). During this line time the print head received constant power. The average printing power, being the total amount of electrical input energy during one line time divided by the line time and by the surface area of the heat-generating resistors was 1.6 mJ/dot being sufficient to obtain maximum optical density in each of the thermographic materials of COMPARATIVE EXAMPLES 1 to 3 and INVENTION EXAMPLES 1 & 2.

Image Evaluation

The maximum densities, $D_{max}$, and minimum densities, $D_{min}$, of the prints given in table 3 for COMPARATIVE EXAMPLES 1 to 3 and INVENTION EXAMPLES 1 & 2 respectively were measured through a blue filter with a MACBETH™ TR924 densitometer in the grey scale step corresponding to data levels of 255 and 0 respectively and are also given in table 3.

Archivability Test

The achivability of prints made with the thermographic materials of COMPARATIVE EXAMPLES 1 to 3 and INVENTION EXAMPLES 1 & 2 was evaluated on the basis of the observed changes in minimum density upon heating the prints at 35° C. in a relative humidity (RH) of 80% for 3 days in the dark. The results of these tests are given in table 3.

Light Box Test

The stability of the image background of the prints made with the thermographic materials of COMPARATIVE EXAMPLES 1 to 3 and INVENTION EXAMPLES 1 & 2 was evaluated on the basis of the change in minimum (background) density measured through a blue filter using a MACBETH™ TR924 densitometer upon exposure on top of the white PVC window of a specially constructed light-box placed for 3 days in a VÖTSCH conditioning cupboard set at 30° C. and a relative humidity (RH) of 85%. Only a central area of the window 550 mm long by 500 mm wide was used for mounting the test materials to ensure uniform exposure.

The stainless steel light-box used was 650 mm long, 600 mm wide and 120 mm high with an opening 610 mm long and 560 mm wide with a rim 10 mm wide and 5 mm deep round the opening, thereby forming a platform for a 5 mm thick plate of white PVC 630 mm long and 580 mm wide, making the white PVC-plate flush with the top of the light-box and preventing light loss from the light-box other than through the white PVC-plate. This light-box was fitted with 9 PLANILUX™ TLD 36W/54 fluorescent lamps 27 mm in diameter mounted length-wise equidistantly from the two sides, with the lamps positioned equidistantly to one another and the sides over the whole width of the light-box and with the tops of the fluorescent tubes 30 mm below the bottom of the white PVC plate and 35 mm below the materials being tested. The results are summarized in table 3.

TABLE 3

| | AgBeh cover age [g/m²] | subbing layer nr | subbing layer adhesion | FRESH $D_{max}$ vis/blue | FRESH $D_{max}$ vis/blue | Archivability $\Delta D_{min}$ vis/blue after 3d at 35° C./80% RH | Light box $\Delta D_{min}$ vis/blue after 3d at 30° C./85% RH |
|---|---|---|---|---|---|---|---|
| | | | | Comparative example number | | | |
| 1 | 3.68 | — | poor | 3.12/3.23 | 0.07/0.08 | 0.00/0.00 | 0.06/0.11 |
| 2 | 4.13 | C1 | excellent | 3.40/3.55 | 0.08/0.10 | 0.00/0.00 | 0.10/0.28 |
| 3 | 3.58 | C3 | excellent | 2.65/2.71 | 0.08/0.09 | 0.00/0.00 | 0.06/0.14 |
| | | | | Invention example number | | | |
| 1 | 3.87 | O1 | excellent | 3.05/3.13 | 0.08/0.09 | 0.00/0.00 | 0.05/0.12 |
| 2 | 3.84 | O2 | excellent | 2.82/2.87 | 0.08/0.09 | 0.00/0.00 | 0.06/0.13 |

The results of the thermographic evaluation of the thermographic material of COMPARATIVE EXAMPLE 1 demonstrate the excellent archivability and light box stability (=reduced $\Delta D_{min}$ values) with unsubbed PET, but also the poor adhesion of the thermosensitive element thereon.

The results of COMPARATIVE EXAMPLES 2 and 3 and INVENTION EXAMPLES 1 and 2 show that although excellent adhesion was observed between the support and the common thermosensitive element with all the subbing layers used, the choice of subbing layer, surprisingly, because of the relative bulk of the subbing layer compared with that of the thermosensitive element, had a considerable influence upon the archivability and light box stability of the resulting thermographic materials. This is particularly marked with the thermographic recording material of COMPARATIVE EXAMPLE 2 with subbing layer number C1 with 1.95 mg/m² of leachable chloride ions and less marked with the thermographic recording material of COMPARATIVE EXAMPLE 3 with subbing layer number C3 with 0.65 mg/m² of leachable chloride ions, due to the poorish light stability of the thermosensitive element itself, which largely masked any slight differences in the influence of the subbing layers upon the light stability of the thermographic recording material as a whole, as shown by the small differences in $\Delta D_{min}$ (blue) after the light box test between the thermographic recording materials of COMPARATIVE EXAMPLE 3 with a subbing layer falling outside that used in the thermographic recording material of the present invention and INVENTION EXAMPLES 1 and 2 with subbing layer number 01 and 02 with 0.3 mg/m² and <0.5 mg/m² of leachable chloride ions respectively used in the thermographic recording materials according to the present invention.

COMPARATIVE EXAMPLE 4 & INVENTION EXAMPLE 3

Preparation of the Silver Behenate Dispersion

The silver behenate dispersion was produced as follows: dispersing 25 kg (73.5M) behenic acid was dispersed with stirring at at 80° C. in 1 g of a 10% solution of Surfactant Nr 5/g behenic acid made up to 250L with deionized water at a temperature of 80° C.; then 36.75L of a 2M aqueous solution of sodium hydroxide was added over a period of 10 to 20 minutes to give a clear solution substantially containing sodium behenate; then 25L of a 2.94M aqueous solution of silver nitrate was added with stirring at a rate of 0.163 moles/moles silver behenate-min to convert the sodium behenate completely into silver behenate; and finally ultrafiltration was carried out with a 500000 MW polysulfone cartridge filter at room temperature to concentrate the resulting silver behenate dispersion, the final AgB-concentration was 16.7% with 0.07 g of Surfactant Nr 5/g AgB, the residual conductivity was 1.0 mS/cm.

Preparation of the Thermosensitive Element

175 μm thick blue pigmented polyethylene terephthalate supports coated with subbing layer numbers C3 & 01 were coated with an aqueous coating composition and the following ingredients so to obtain thereon, after drying at 18 to 20° C. for 93s in a stream of air with a flow rate of 950 kg/min, a thermosensitive element containing:

| | |
|---|---|
| * AgBeh: | 4.94 g/m² |
| * GEL01: | 4.96 g/m² |
| * formaldehyde | 0.2 g/m² |
| * Surfactant Nr. 7 | 0.004 g/m² |
| * Surfactant Nr. 8 | 0.32 g/m² |
| * Surfactant Nr. 9 | 0.13 g/m² |
| * R01 | 1.00 g/m² |
| * T02 | 0.53 g/m² |
| * boric acid | 0.18 g/m² |
| * ammonium tetraborate | 0.48 g/m² |

and to produce the thermographic recording materials of COMPARATIVE EXAMPLE 4 & INVENTION EXAMPLE 3 respectively.

EVALUATION

Thermographic evaluation and evaluation of the adhesion between the support and the thermosensitive element was carried out as described above for COMPARATIVE EXAMPLES 1 to 3 and INVENTION EXAMPLES 1 & 2 except the archivability tests were carried out for 4 days at 45° C. and 70% relative humidity instead of 3 days at 35° C. and 80% relative humidity. The results are summarized in table 4.

TABLE 4

| | AgBeh coverage [g/m²] | subbing layer nr | subbing layer adhesion | FRESH $D_{max}$ vis/blue | FRESH $D_{min}$ vis/blue | Archivability $\Delta D_{min}$ vis/blue after 4d at 45° C./70% RH | Light box $\Delta D_{min}$ vis/blue after 3d at 30° C./85% RH |
|---|---|---|---|---|---|---|---|
| Comparative example number 4 | 4.94 | C3 | excellent | 3.12/3.23 | 0.23/0.10 | 0.01/0.02 | 0.02/0.04 |
| Invention example number 3 | 4.94 | 01 | excellent | 2.65/2.71 | 0.21/0.10 | 0.00/0.01 | 0.01/0.01 |

A comparison of the $\Delta D_{min}$-values both through visible and blue filters for the thermographic recording material of INVENTION EXAMPLE 3 with that for the thermographic recording material of INVENTION EXAMPLE 1 with the same subbing layer shows a substantial reduction, indicating a substantial improvement in stability to light due to the use of a different, more stable, thermosensitive element. With this more stable thermosensitive the thermographic recording material of INVENTION EXAMPLE 3 using subbing layer number 01 with a leachable chloride content of 0.3 mg/m² exhibited a significantly lower sensitivity to light, reduced $\Delta D_{min}$-values, compared with the thermographic recording material of COMPARATIVE EXAMPLE 4 using subbing layer number C3 with a leachable chloride content of 0.65 mg/m² outside the chloride content of the subbing layers used in the thermographic recording material according to the present invention.

Having described in detail preferred embodiments of the current invention, it will now be apparent to those skilled in the art that numerous modifications can be made therein without departing from the scope of the invention as defined in the following claims.

What is claimed is:

1. A substantially light-insensitive black and white thermographic material comprising (a) a polymeric or polymer-coated support;

(b) a subbing layer on said support, (i) wherein said subbing layer includes a subbing layer binder selected from the group consisting of polymer latex, polysilicic acid, melamine-formaldehyde resin, hydrolyzed polyalkoxysilanes and any mixture thereof, and when said binder contains covalently bonded acid groups said acid groups are substantially present as free acids or substantially present as acid salts, (ii) wherein said subbing layer has a leachable non-fluoro-halide ion content into water at room temperature over a period of 120 minutes of less than 0.6 mg/m², and (iii) wherein said subbing layer contains silica and less than 20% by weight of said subbing layer is silica, (c) a thermosensitive element on the same side of said support as said subbing layer, said thermosensitive element containing (i) a substantially light-insensitive organic silver salt, (ii) a reducing agent for the reduction of the substantially light-insensitive organic silver salt, and (iii) a thermosensitive element binder.

2. Substantially light-insensitive thermographic material according to claim 1, wherein said leachable non-fluoro-halide ion content of said subbing layer is less than 0.5 mg/m².

3. Substantially light-insensitive thermographic material according to claim 1, wherein said non-fluoro-halide ion is a chloride ion.

4. Substantially light-insensitive thermographic material according to claim 1, wherein said polymer latex is producible with monomers selected from the group consisting of acrylates, methacrylates, vinyl esters, acrylic acid, methacrylic acid, itaconic acid, vinylidene chloride, polyisocyanates, aromatic polycarboxylic acids and polyols.

5. Substantially light-insensitive thermographic material according to claim 1, wherein said wherein said thermosensitive element is coated with a protective layer.

6. Substantially light-insensitive thermographic material according to claim 1, wherein said substantially light-insensitive organic silver salt is a silver salt of an organic carboxylic acid.

7. A process for producing a substantially light-insensitive thermographic material comprising (a) a polymeric or polymer-coated support; (b) a subbing layer on said support, (i) which contains a subbing layer binder selected from the group consisting of polymer latex, polysilicic acid, melamine-formaldehyde resin, hydrolyzed polyalkoxysilanes and any mixture thereof, and when said binder contains covalently bonded acid groups, said acid groups are substantially present as free acids or substantially present as acid salts, (ii) wherein said subbing layer has a leachable non-fluoro halide ion content into water at room temperature over a period of 120 minutes of less than 0.6 mg/m² and, (iii) wherein said subbing layer contains silica and less than 20% by weight of said subbing layer is silica, and (c) a thermosensitive element on the same side of said support as said subbing layer, said thermosensitive element containing (i) a substantially light-insensitive organic silver salt, (ii) a reducing agent for the reduction of the substantially light-insensitive organic silver salt and (iii) a thermosensitive element binder, said process comprising the steps of:

(A) coating said support with a subbing layer composition to form said subbing layer;

(B) producing one or more aqueous coating compositions together containing said substantially light-insensitive organic silver salt, said reducing agent and said thermosensitive element binder; and (C) applying said one or more of said aqueous coating compositions to the same side support as said subbing layer to form after drying, said thermosensitive element.

8. A substantially light-insensitive black and white thermographic material comprising (a) a polymeric or polymer-coated support, (b) a subbing layer on said support (i) which contains a subbing layer binder selected from the group consisting of polyethylene wax, polymer latex and mixtures thereof, and when said binder contains covalently bonded acid groups, said acid groups are substantially present as free acids or substantially present as acid salts, (ii) wherein said subbing layer has a leachable non-fluoro-halide ion content into water at room temperature over a period of 120 minutes of less than 0.6 $mg/m^2$, and (iii) wherein less than 20% by weight of said subbing layer is silica, (c) a thermosensitive element on the same side of said support as said subbing layer, said thermosensitive element containing (i) a substantially light-insensitive organic silver salt, (ii) a reducing agent for the reduction of the substantially light insensitive organic silver salt and (iii) a thermosensitive element binder.

9. The substantially light-insensitive thermographic material according to claim 8, wherein said subbing layer contains silica.

10. A process for producing a substantially light-insensitive thermographic material comprising (a) a polymeric or polymer-coated support, (b) a subbing layer on said support, (i) which contains polyethylene wax as a subbing layer binder, (ii) wherein said subbing layer has a leachable non-fluoro halide ion content into water at room temperature over a period of 120 minutes of less than 0.6 $mg/m^2$, and (iii) wherein less than 20% by weight of said subbing layer is silica and (c) a thermosensitive element on the same side of said support as said subbing layer, said thermosensitive element containing (i) a substantially light-insensitive organic silver salt, (ii) a reducing agent for the reduction of the substantially light-insensitive organic silver salt and (iii) a thermosensitive element binder, said process comprising the steps of:

(A) coating said support with a subbing layer composition to form said subbing layer;

(B) producing one or more aqueous coating compositions together containing said substantially light-insensitive organic silver salt, said reducing agent and said thermosensitive element binder; and (C) applying said one or more of said aqueous coating compositions to the same side of the support as said subbing layer to form after drying, said thermosensitive element.

11. A substantially light-insensitive black and white thermographic material comprising a polymeric or polymer-coated support, a subbing layer on said support and on the same side of said support as said subbing layer a thermosensitive element containing a substantially light-insensitive organic silver salt, a reducing agent therefor in thermal working relationship therewith and a binder, wherein said subbing layer consists essentially of one or more polymer latexes, where any covalently bonded acid groups in said polymer latexes are either substantially present as free acid or substantially present as acid salts, and said subbing layer has less than 20% by weight silica and has a leachable non-fluoro-halide ion content into water at room temperature over a period of 120 minutes of less than 0.6 $mg/m^2$.

* * * * *